United States Patent [19]

Wendt

[11] 3,945,167

[45] Mar. 23, 1976

[54] CLIP FOR THE ASSEMBLY OF COMPOSITE STRUCTURAL MEMBERS

[75] Inventor: Alan C. Wendt, Barrington, Ill.

[73] Assignee: United States Gypsum Company, Chicago, Ill.

[22] Filed: June 4, 1975

[21] Appl. No.: 583,364

Related U.S. Application Data

[63] Continuation of Ser. No. 411,606, Nov. 1, 1973, abandoned.

[52] U.S. Cl. ..... 52/714; 52/731; 52/760

[51] Int. Cl.[2] ..... E04B 1/58

[58] Field of Search ..... 52/731, 730, 760, 36, 488, 52/714; 24/73 B, 81 B

[56] References Cited

UNITED STATES PATENTS

| | | | |
|---|---|---|---|
| 2,059,565 | 11/1936 | Driver | 52/127 |
| 2,123,458 | 7/1938 | Woehler | 52/730 |
| 2,975,874 | 3/1961 | Pagan | 52/731 |
| 3,234,702 | 2/1966 | Zibell | 52/488 |
| 3,300,934 | 1/1967 | Waizenhofer | 52/760 |
| 3,463,325 | 8/1969 | Zagotta | 52/760 |
| 3,466,436 | 9/1969 | Spicer | 24/73 B |
| 3,606,223 | 9/1971 | Havener | 24/73 B |
| 3,695,456 | 10/1972 | Lewis | 52/760 |
| 3,854,001 | 12/1974 | Dola | 24/73 B |

*Primary Examiner*—Frank L. Abbott
*Assistant Examiner*—Henry Raduazo
*Attorney, Agent, or Firm*—Donnie Rudd; Stanton T. Hadley; Samuel Kurlandsky

[57] ABSTRACT

A clip and assembly of two structural channels front-to-back by use of the clip, the clip having a one-channel connecting portion and means for gripping portions of the side flanges of the other channel.

3 Claims, 11 Drawing Figures

CLIP FOR THE ASSEMBLY OF COMPOSITE STRUCTURAL MEMBERS

This is a continuation of application Ser. No. 411,606, filed Nov. 1, 1973 and now abandoned.

BACKGROUND OF THE INVENTION

1. Field of the Invention

Because of the high cost of lumber, the construction industry is turning more and more to the use of metal members for studs, joists, columns, and beams. Such members are generally in the form of channels, and as such require specialized fastening techniques. As is known, channels conventionally comprise an elongate web portion and two side flanges emanating from the longitudinal margins of the web portion, and from the same face of the portion. Thus, simply nailing channel members together is no longer possible nor desirable.

In some instances, such as in framing doors and windows, it is particularly desirable that two such channels be joined together back to front, with their longitudinal axes aligned, to create the rough jamb. The composite so formed is secured to a wood jamb the surface of which is finished, and also, in some cases, is secured to the gypsum board. Conventionally, the wood jamb is secured to a web of the channels, while the gypsum board is attached to the channel side flanges.

The invention concerns means for joining channels together in such a manner, whereby a composite structural member is created.

2. Description of the Prior Art

Channel members have been assembled together in a variety of configurations, by means of a variety of clips. Thus, channels have been held together at right angles to each other, by clips such as those shown in U.S. Pat. No. 3,319,983. These have not been suitable, however, to join the channels together with their axes aligned. One quite apparent reason is the absence in such clips of a portion connecting the clip to the web of one of the channels — a necessary feature when the channels are joined back to front.

Still other channels have been joined by clips with their longitudinal axes aligned, but conventionally the junction is achieved front-to-front. Clips for such an assembly again lack the capability for connection to the web, and instead emphasize the use of tabs or notches for gripping the side flanges of the channels. Examples are shown in U.S. Pat. Nos. 2,059,565 and 2,123,458. The difficulty with this construction is that both channels are closed off, leaving the interior inaccessible, such as is necessary for the insertion of insulation. Furthermore, it is necessary that the web portion of both channels be as close as possible to the wood portion of the jamb, when used for this purpose, for maximum strength. A front-to-front construction obviously spaces one web portion too far from the other.

A recent technique has permitted the channels to be joined back-to-front. As depicted in FIG. 1, this prior construction requires the use of a wood blocking between the two channels. The disadvantage of such a technique is that it renders difficult the screw attachment of the wood jamb or the gypsum board to the composite member.

SUMMARY OF THE INVENTION

The invention pertains to a clip, and the composite structural member which may be assembled therewith, which clip readily permits two channels to be secured front-to-back with their axes secured, without substantially interfering with subsequent attachment of other wall elements to the composite member. More specifically, there is provided a composite structural member comprising two elongate channels each having a web, two side flanges extending from opposite side margins of the web, and a longitudinal axis extending parallel to the side flanges; and a clip connecting the channels together with the axes of the channels parallel to each other, said clip having a portion attached to the web of one of said channels, and means for gripping a portion of the side flange of the other of said channels.

Accordingly, it is an object of the invention to provide a clip, and the front-to-back assembly of channels using such a clip, to form a member particularly suited for use as framing for doors and windows.

It is a related object of the invention to provide such a clip and assembly without interfering with the capability of the assembly to secure wood jambs and gypsum panels in place.

It is another object of the invention to provide such a clip which will accommodate a particular shape of channel used in the assembly.

Other objects and advantages will become apparent upon reference to the following description of the drawing and of the preferred embodiments.

DESCRIPTION OF THE PREFERRED EMBODIMENTS

Although the invention is hereinafter described with particular reference to its use and advantages in the construction of the framing for door or window jambs, it is not necessarily limited thereto. It may be applied in any instance where two hollow, elongate structural members are to be secured front-to-back, preferably with their axes aligned.

Figure 1:
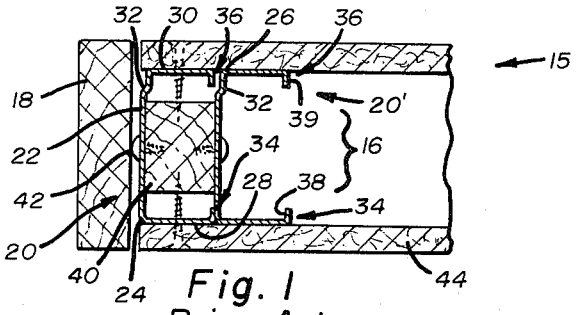
Fig. 1 Prior Art
FIG. 1 is a fragmentary horizontal sectional view through a prior art frame.

FIG. 1 illustrates the prior art construction over which the invention is intended to improve. Thus, a door jamb 15 comprises the rough jamb 16 to which is joined the wood jamb 18 which is to be given a decorative finish. The rough jamb comprises two elongate C-shaped structural members or channels 20, 20' each of which is provided with a web portion 22 having opposite side margins 24 and 26, and side flanges 28 and 30 projecting from margins 24 and 26, respectively, from the same face of web portion 22. Although channels 20, 20′ may have any general shape, preferably they are those shown in copending U.S. application Ser. No. 241,611 filed on Mar. 27, 1972, commonly owned with the instant application. That is, they are asymmetrical chanels due to the indent 32 in the web portion. As shown in phantom in FIG. 3, the indent is designed to allow two of the channels to be nested or boxed together without departing from a perfect rectangular configuration. To do this, it will be recognized that the terminal portions 34 and 36 of side flanges 28 and 30, respectively, lie in planes spaced apart a distance such that the inside surface 38 of portion 34 is generally coplanar with the outside surface 39 of portion 36.

To attach the channels 20 and 20′ together, the prior art technique was to insert a wooden blocking 40 into channel 20, and the web portions 22 of both channels were screw-attached at 42 to the blocking. As will be appreciated, such an assembly can result in screw attachment of the jamb 18 to the web portion of channel 20 precisely at the location of the blocking. If the screw used in such attachment strikes screw 42, it will be deflected and the attachment of jamb 18 will be inaccurate. Even if screw 42 is not in the way, as will be the case usually, the blocking 40 will still make the attachment more difficult as a metal tapping screw is not designed for efficient wood penetration. Similarly, the screw attachment of gypsum board 44 to the side flange 28 of the channel 20 may result in the blocking causing the screw to undesirably deflect the side flange.

Figure 2:
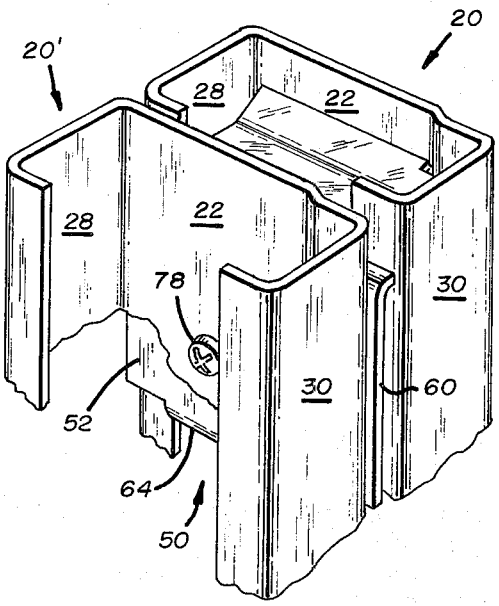
FIG. 2 is a fragmentary perspective view of the frame assembly constructed in accordance with the invention.
Figure 3:
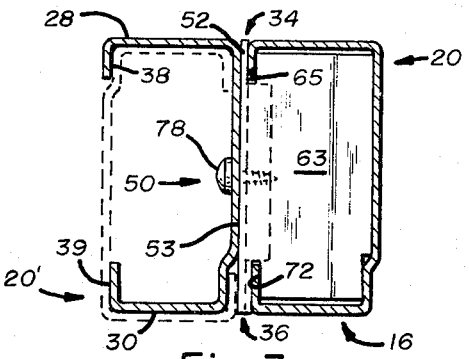
FIG. 3 is a horizontal sectional view similar to FIG. 1, but illustrating the assembly of FIG. 2.
Figure 4:
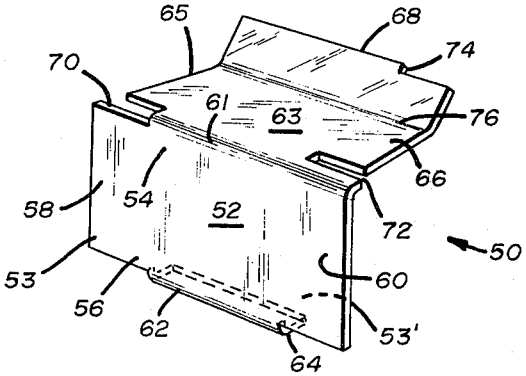
FIG. 4 is a perspective view of the clip used in the assembly of FIGS. 2 and 3.

In accordance with one aspect of the invention, illustrated in FIGS. 2–4, the channels 20, 20′ may be connected front-to-back with their axes aligned, by a clip 50. The clip comprises, as best shown in FIG. 4, a member or channel-connecting portion 52 having front and back surfaces 53, 53′ and opposite side margins 54, 56 and 58, 60. The side margins 54, 56 each have joined to them at intersections 61 and 62, a lip 63 and 64, respectively, which lips extend at an angle from the portion 52 from the back surface 53′ thereof. Lip 63 has opposite side margins 65, 66 and a terminal edge 68 opposite to intersection 61.

It is necessary that the clip grip the side flanges of channel 20. The means by which this is achieved comprise the lip 63 in its interaction with the web portion 22 of channel 20, as described below, and notches 70 and 72 formed adjacent the intersection 61 in the side margin 58 of portion 52 and side margins 65 and 66 of lip 63. By locating notch 70 so as to be collinear with the intersection 61, the notch extends into both portion 52 and lip 53. Both notches have a depth sufficient to accommodate terminal portions 34 and 36, respectively, of channel 20. As best seen in FIG. 3, side flange terminal portion 36 of channel 20 is spaced away from terminal portion 34, due to the asymmetric nature of the channel. Thus, to receive terminal portion 36, notch 72 is spaced away from intersection 61, towards the edge 68. Inasmuch as terminal portions 34 and 36 are parallel, so are notches 70 and 72. If the terminal portions are differently bent, the notches must be shaped accordingly.

Lip 63 assists in frictionally engaging the channel 20 to hold the clip in the desired longitudinal position therein. Therefore, the lip extends across the interior of channel 20 until it frictionally engages web portion 22 of that channel. For maximum engagement, edge 68 extends generally the full width of web portion 22, and is contoured to coincide with the contour of the web portion 22. Thus, edge 68 is indented at 74 identically as is web portion 22 indented at 32, along a line unequally positioned from side margins 65, 66. The lip 63 is further bent at 76 to provide downward pressure against lip 64, and to provide the resiliency necessary for forced repositioning of the clip, if desired.

To prevent accidental twisting or rotation of the clip within channel 20, as by the action of screw attachment of channel 20′ described below, lip 64 extends with a width which locates it between the side flanges 28 and 30 of channel 20. In other words, the width of lip 64 must be less than the distance of separation of the side flanges. Generally this will mean a width less than or about equal to the distance of separation of notches 70,72. To prevent undue rotation of the clip, the distances are preferably about equal.

In the assembly of the rough jamb 16, channel 20 is properly oriented, and clip 50 inserted with lip 63 contained within channel 20. The clip is twisted so as to extend transversely across the channel, notches 70 and 72 receiving and gripping the side flange terminal portions 34 and 36, respectively. Edge 68 of lip 63 retains the clip from accidental longitudinal displacement. The second channel 20′ is positioned with its web portion 22 abutting surface 53 of portion 52. A metal tapping screw 78 is then screwed into the abutting portions, lip 64 serving to prevent the clip from rotating out of engagement with the side flanges of channel 20.

The composite member so constructed avoids the use of a blocking member having substantial longitudinal extension which might interfere with the assembly of the composite member into framing to form, for example, a door jamb. Only lip 63 extends across the space into which attaching screws project, and the minimal thickness of the sheet metal forming the lip eliminates the likelihood of screw interference.

Figure 5:
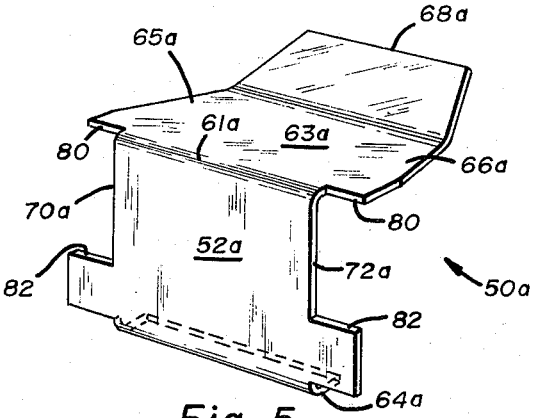
FIG. 5 is a perspective view of a clip forming an alternate embodiment of the invention.
Figure 6:
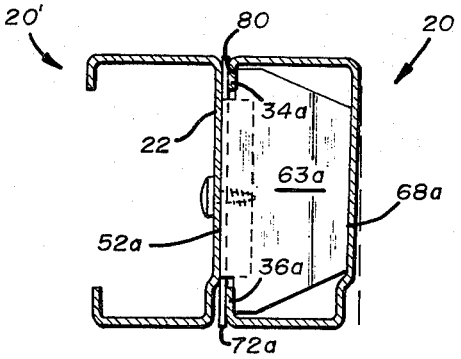
FIG. 6 is a sectional view similar to FIG. 3, but illustrating the embodiment of FIG. 5.

It also will be readily apparent that asymmetric clip 50 will fit within asymmetric channel 20 only in one orientation. That is, the clip may not be attached with lips 63 and 64 reversed from the position shown in FIG. 4. Thus, if channel 20 is accidentally or otherwise rotated so that indent 32 is on the opposite side of web portion 22 from that shown, then the applicator must rotate the clip also. To avoid the applicator having to know which orientation of the clip is required, the alternate embodiment shown in FIGS. 5 and 6 may be used. Parts similar to those previously described bear the same reference numeral to which the distinguishing suffix *a* has been attached. Thus, clip 50*a* joins the identical channels 20 and 20′ as described above, by means of portion 52*a* which is screw-attached to web portion 22 of channel 20′ (FIG. 6). Lip 63*a* frictionally engages the web portion, and lip 64*a* fits between the side flanges of channel 20. However, notches 70*a* and 72*a* extend continuously from portion 52*a* through the intersection 61*a* and into lip 63*a* where the notches have coplanar terminal surfaces 80. The opposite terminal surfaces 82 also may, but need not, be coplanar. The lip 63*a* is also modified by having tapered side margins 65*a* and 66*a*, and a terminal edge 68*a* which falls in a single plane. The assembly of clip 50*a* with channels 20 and 20′ is thus possible due to the resiliency of the web portion 22 of channel 20. That is, terminal portion 36*a* is pulled into a coplanar position with terminal portion 34*a* by reason of terminal surface 80 of notch 72*a* being coplanar with the terminal surface 80 of notch 70*a*. This necessarily deflects the web portion 22 of channel 20 out of the plane of its natural, free position, shown by the dotted line, FIG. 6. By this construction, it is not necessary that the applicator reverse the clip orientation if the channel 20 is put in place upside down.

Figure 7:
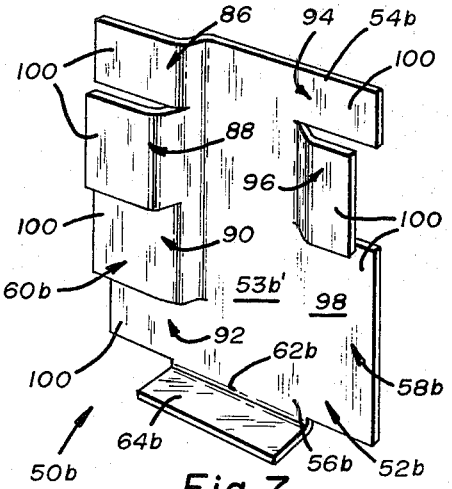
FIG. 7 is a perspective view illustrating yet another embodiment of the invention.
Figure 9:
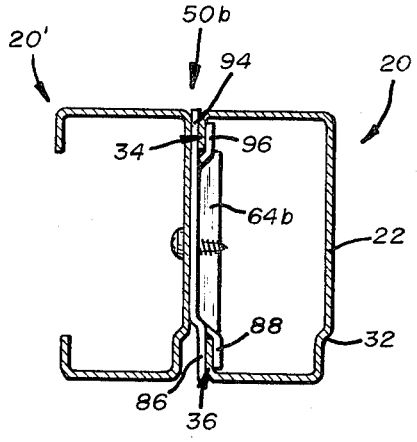
FIG. 9 is a horizontal sectional view illustrating the assembly using the clip of FIGS. 7 and 8.
Figure 8:
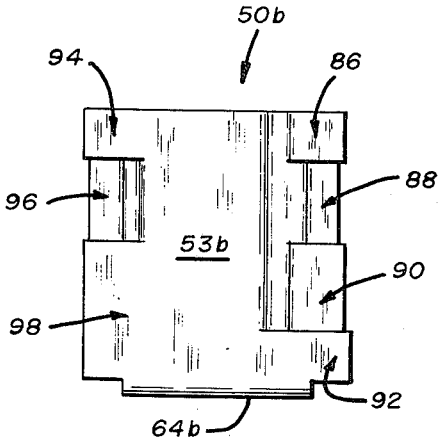
FIG. 8 is a front elevational view of the clip shown in FIG. 7.

In accordance with another aspect of the invention, FIGS. 7 through 9 illustrate another embodiment wherein the web-abutting friction lip has been eliminated. Parts similar to those previously described bear the same reference numeral to which the distinguishing suffix *b* has been added. Thus, the composite member comprises two channels 20 and 20' joined front-to-back by a clip 50*b* (FIG. 9). As before, it comprises a channel-connecting portion 52*b* having front and back surfaces 53*b* and 53*b'*, respectively, opposite side margins 54*b*, 56*b* and 58*b*, 60*b*, and a lip 64*b* joined to margin 56*b* at intersection 62*b*. Unlike the previous embodiments, the mechanism by which the side flanges of channel 20 are gripped comprises a plurality of tabs 86, 88, 90 and 92 in margin 60*b*, and a plurality of tabs 94, 96, and 98 in side margin 58*b*. Each of these tabs terminates in a portion 100 which lies in a plane which is parallel to the planes of the portion 100 of the other tabs. Each portion 100 is spaced from the portion 100 of the next adjacent tab by a distance slightly less than the thickness of the terminal portions 34 and 36 of channel 20. Portion 100 of tab 88 lies in a plane located outside the plane of any other portion, while portions 100 of tabs 86 and 90 are coplanar. Similarly, portions 100 of tabs 94 and 98 are coplanar.

Thus, the terminal portion 36 is received within and gripped by tab 88 on one side and tab 86, 90 on the other side. Terminal portion 34 is received between and gripped by tab 96 on one side and tabs 94 and 98 on the other.

As best seen in FIG. 9, because of the asymmetric nature of channel 20, the space between opposed tabs on side margin 58*b* for reception of terminal portions 34 does not fall in the same plane as the space for reception of portion 36. The separation of the terminal portions is such that portion 100 of tab 96 is preferably coplanar with portion 36 of channel 22. Thus, none of tab portions 100 are coplanar with the tab portions of the opposite side margin.

The assembly process of the channels 20, 20' is similar to that as disclosed above for FIG. 3.

Figure 10:
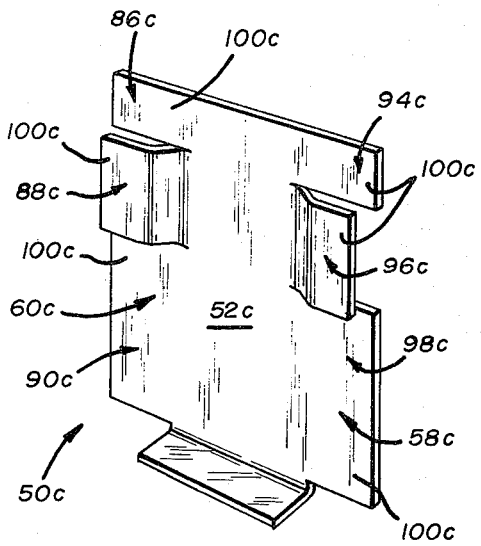
FIG. 10 is a perspective view of still another embodiment.
Figure 11:
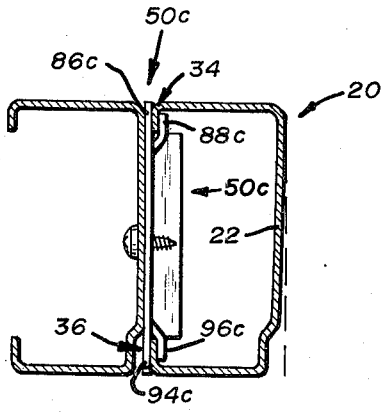
FIG. 11 is a sectional view of the assembly incorporating the clip of FIG. 10.

It will be readily apparent that clip 50*b* is asymmetric to fit the asymmetric nature of the side flanges of channel 20. As with FIG. 2, the drawback is that the applicator must take care as to which side of web portion 22 the indent 32 of channel 20 is located, so as to know which orientation the clip must have. This problem may be avoided by using the embodiment shown in FIGS. 10 and 11. Parts similar to those previously described bear the same reference numeral to which the distinguishing suffix *c* has been added. Thus, clip 50*c* joins the two channels together in a manner similar to the assembly shown in FIG. 9, with tab portions 100*c* being parallel to each other. Unlike the previous embodiment, web-connecting portion 52*c* has a plane of symmetry along a vertical axis positioned between side margins 58*c* and 60*c*. Transversely positioned tabs 86*c* and 94*c*, 88*c* and 96*c*, and 90*c* and 98*c* are respectively coplanar, therefore. Because the spaces between the tabs for reception of terminal portions 34 and 36 of channel 20 are thus coplanar, the asymmetric channel 20 is forced to deflect at web portion 22 from its free or natural position shown in dotted lines, FIG. 11. For this reason, the correct assembly of the clip is not dependent upon the orientation of the asymmetric channel 20, and the applicator need not concern himself with the proper orientation of the clip with respect to the right or left-handedness of the channel.

It will be recognized that the embodiments of FIGS. 7–11 further meet the objectives set forth above, inasmuch as no lip whatsoever extends across the interior of channel 20 into which attaching screws project.

Although the invention has been described in connection with certain preferred embodiments, it is not intended that it be limited thereto. Thus, the clip of the invention will permit the channels to be assembled with the axes misaligned, as well as aligned. Therefore, it is intended that it cover all alternative arrangements, equivalents, and embodiments as may be included within the scope of the following claims.

What is claimed is:

1. A clip for assembling two hollow, elongate sheet metal channel members having a generally C-shaped, cross-section, to form a composite structural member, the clip comprising a first structural member-connecting portion having two opposite side margins, and.

a first and a second lip each extending at an angle from two other, opposite side margins of said portion, said first lip having opposite side margins, at least one of said side margins of both said member-connecting portion and of said first lip being provided with a notch adjacent to the intersection of said first lip and said first member-connecting portion thereby forming at least two notches on opposing sides of said clip, extending into said lip a distance sufficient to accommodate therewithin the terminal portions of the side flanges of one of the structural members, one of said notches being offset with respect to the other of said notches, and wherein said second lip has a width which is less than the distance of separation between said notches, whereby said lip may be inserted between the terminal portions of the side flanges of one of the structural members thereby contacting each of the terminal portions of the side flanges to prevent the clip from twisting with respect to said one structural member.

2. The clip as defined in claim 1 wherein said notches are parallel.

3. The clip as defined in claim 1 wherein said notches both extend continuously from said member-connecting portion, through said intersection, and into said first lip, and wherein said first lip terminates in an edge which lies in a single plane, whereby the clip may be secured to an asymmetrical member having a generally C-shaped cross-section, regardless of which orientation the member is in.

* * * * *